US006041797A

United States Patent [19]

Casselman

[11] Patent Number: 6,041,797

[45] Date of Patent: Mar. 28, 2000

[54] APPARATUS FOR CLEANING A VACUUM DRUM

[76] Inventor: David S Casselman, 409 Goff Field La., Hopkins, S.C. 29061

[21] Appl. No.: 08/987,275

[22] Filed: Dec. 9, 1997

[51] Int. Cl.[7] ..... B08B 3/04

[52] U.S. Cl. ..... 134/152; 134/166 R; 134/169 R; 134/170; 134/200; 134/201

[58] Field of Search ..... 134/166 R, 169 R, 134/170, 22.18, 22.1, 169 A, 152, 167 C, 168 C, 200, 201, 171, 186

[56] References Cited

U.S. PATENT DOCUMENTS

| | | | |
|---|---|---|---|
| 3,122,151 | 2/1964 | Chambers | 134/99 |
| 3,448,746 | 6/1969 | Butler | 134/102 |
| 3,608,567 | 9/1971 | Neill | 134/58 |
| 4,102,791 | 7/1978 | Otte . | |
| 4,205,541 | 6/1980 | Zucker . | |
| 4,261,831 | 4/1981 | Linsenmeyer . | |
| 4,299,245 | 11/1981 | Clapper | 134/140 |
| 4,616,489 | 10/1986 | Wood et al. . | |
| 4,622,145 | 11/1986 | Bratten . | |
| 4,759,846 | 7/1988 | MacFarlane . | |
| 4,788,739 | 12/1988 | Brewer et al. . | |
| 4,844,760 | 7/1989 | Dickey . | |
| 4,978,415 | 12/1990 | Jones . | |
| 5,244,572 | 9/1993 | McAllister . | |
| 5,328,611 | 7/1994 | Lenhart . | |
| 5,348,711 | 9/1994 | Johnson | 422/300 |
| 5,460,019 | 10/1995 | Ojala et al. . | |
| 5,512,120 | 4/1996 | Hinton et al. . | |

*Primary Examiner*—Frankie L. Stinson
*Attorney, Agent, or Firm*—Michael A Mann; Nexsen Pruet Jacobs & Pollard LLP

[57] ABSTRACT

The present invention is an apparatus for cleaning a vacuum drum used for transferring gummed labels. The apparatus operates by sealing the drum and backwashing a cleaning fluid through the vacuum ports to unplug the perimeter holes. The apparatus comprises a cylindrical housing closed on one end by a plate and, on the opposing end, by a detachable lid. A drum seat, the size of which corresponds to the size of the vacuum drum to be washed, is locked to the bottom of the housing. The drum seat has an inlet for receiving the cleaning fluid and means for dispensing the received fluid to the vacuum ports of the vacuum drum under pressure. Initially, the cleaning fluid is heated to dissolve the adhesive. Subsequently, a cooler liquid is flushed through the vacuum drum to cool it for handling.

16 Claims, 7 Drawing Sheets

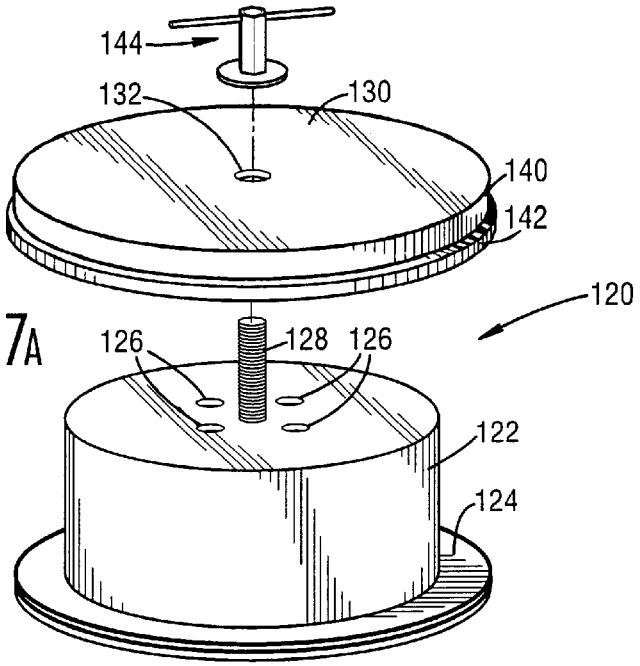
FIG. 7A
FIG. 7B
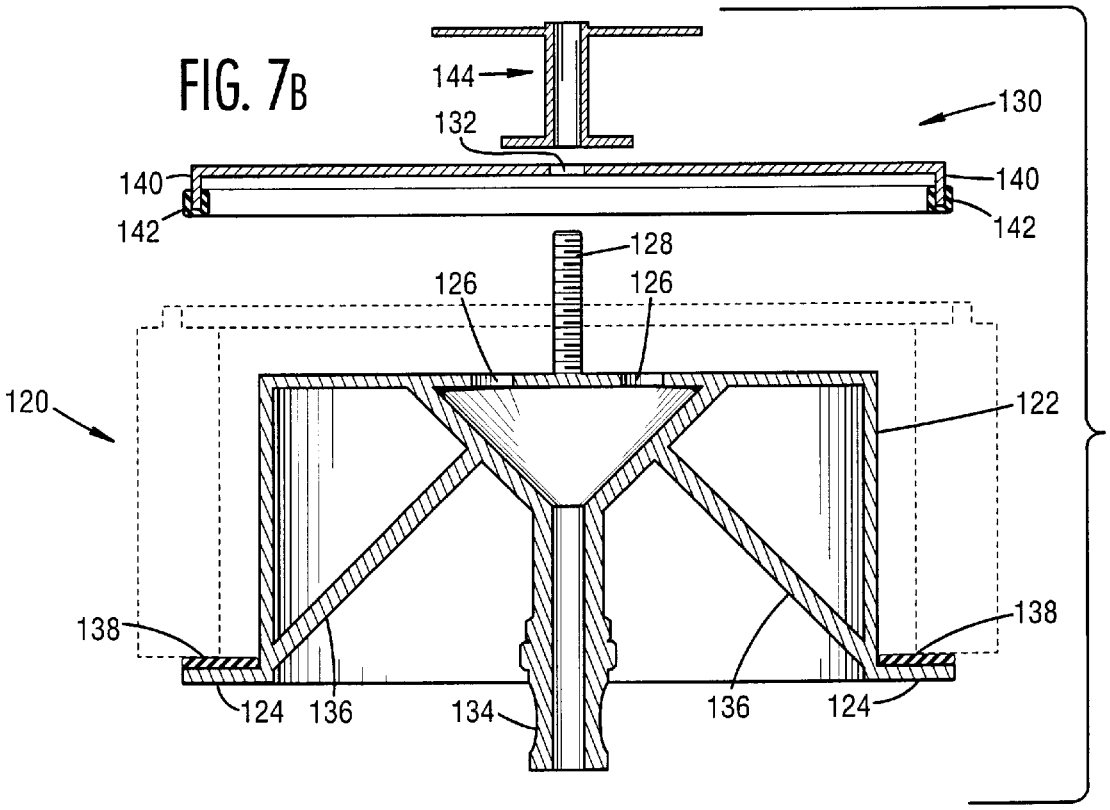

FIG. 8
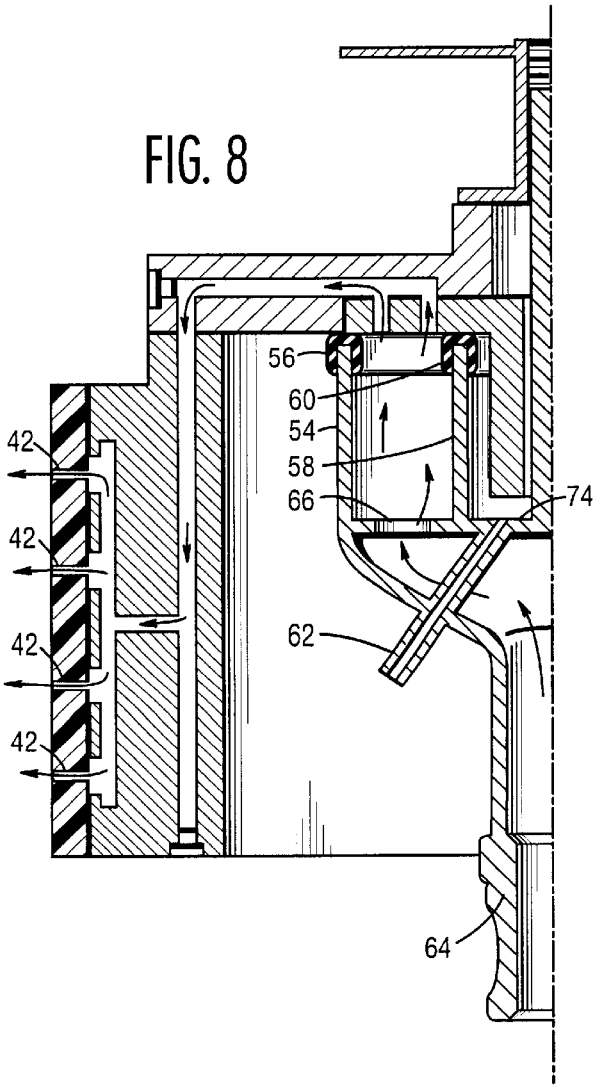
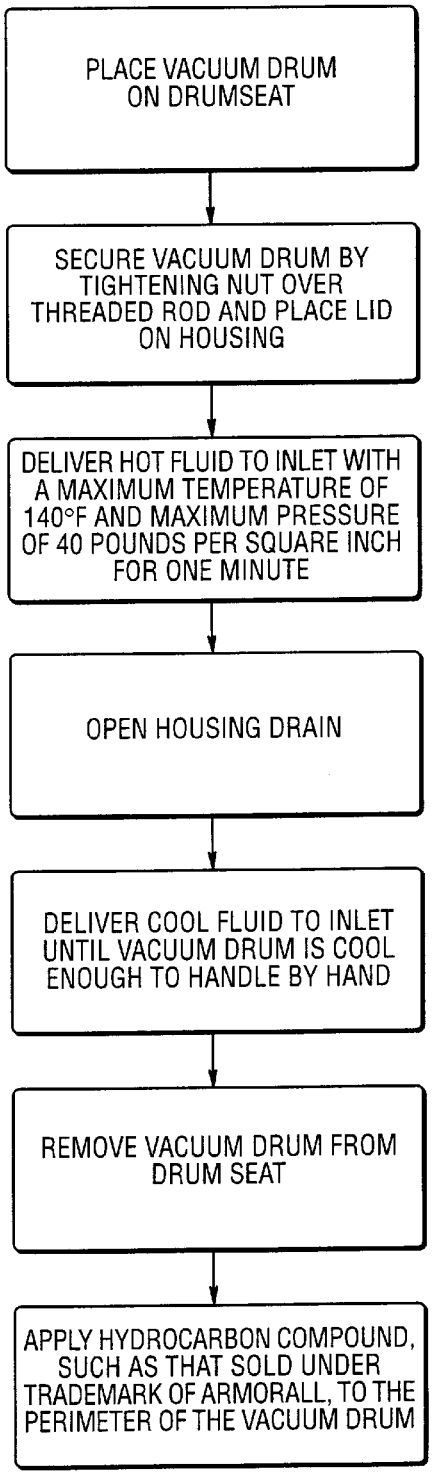
FIG. 9

APPARATUS FOR CLEANING A VACUUM DRUM

BACKGROUND OF THE INVENTION

1. Field of the Invention

The present invention relates to an apparatus for cleaning a vacuum drum that is used for conveying gummed labels.

2. Discussion of Background

Vacuum drums are routinely used in machines that apply labels to containers. A vacuum drum is an open-ended cylinder with a plate on one end and a multiplicity of holes along the perimeter. The holes are in fluid communication with vacuum ports on the end plate. A vacuum is applied to the vacuum ports, which in turn creates suction at the holes along the perimeter of the drum. The vacuum picks up and holds the labels to the drum perimeter as the drum rotates.

In the process of applying labels to containers, the vacuum drum is located adjacent an adhesive station where an adhesive is applied to the labels. The vacuum drum is rotated to transport the labels in front of an adhesive station where adhesive is applied to the labels. In many cases, the adhesive station coats not only the labels, but also spreads adhesive onto the perimeter of the vacuum drum which will eventually plug the perimeter holes. Consequently, over an extended period of time the capability of the vacuum drum to securely hold the labels is reduced.

In order to unplug the holes on the vacuum drum, workers manually clean the drum using handtools. Cleaning the holes is a time consuming task, taking several hours during which labeling operations are suspended. Moreover, it is very difficult to fully unplug the holes and bring the vacuum drum back to its initial capability.

Consequently, there is need for an automated vacuum drum cleaner that can clean different sizes of vacuum drums in order to reduce the time spent cleaning vacuum drums.

SUMMARY OF THE INVENTION

According to its major aspects and broadly stated, the present invention is an apparatus for cleaning a vacuum drum used for transferring gummed labels. The apparatus operates by sealing the drum and backwashing a cleaning fluid through the vacuum ports to unplug the perimeter holes. The apparatus comprises a cylindrical housing closed on one end by a plate and, on the opposing end, by a detachable lid. A drum seat, the size of which corresponds to the size of the vacuum drum to be washed, is locked to the bottom of the housing. The drum seat has an inlet for receiving the cleaning fluid and means for dispensing the received fluid to the vacuum ports of the vacuum drum under pressure. Initially, the cleaning fluid is heated to dissolve the adhesive. Subsequently, a cooler liquid is flushed through the vacuum drum to cool it for handling.

A major advantage of the present invention is the automation of cleaning vacuum drums. The features of the device that allow for the automated capability is a drum seat that seals the vacuum drum coupled with a fluid inlet that backwashes fluid through the vacuum ports thereby forcing the fluid through the perimeter holes.

Another important advantage of the present invention is the reduction in the amount of time to clean a vacuum drum. The present invention creates a drastic reduction in time to clean a vacuum from several hours to only a few minutes. An increase in productivity is created by this advantage so that the entire cost of the labeling will be reduced.

The use of different sized drum seats is an important feature of the present invention. With the ability to interchange different sized drum seats, the present invention may adapt to clean many different sizes of vacuum drums with the same apparatus.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 7A is an exploded perspective view of a drum seat according to another preferred embodiment of the present invention;

FIG. 7B is a cross-sectional view of a drum seat according to another preferred embodiment of the present invention;

FIG. 8 is a detailed cross-sectional view of the vacuum drum shown in FIG. 6A in use according to a preferred embodiment of the present invention; and FIG. 9 is a flow chart of the process for cleaning a vacuum drum according to a preferred embodiment of the present invention.

DETAILED DESCRIPTION OF A PREFERRED EMBODIMENT

Figure 1:
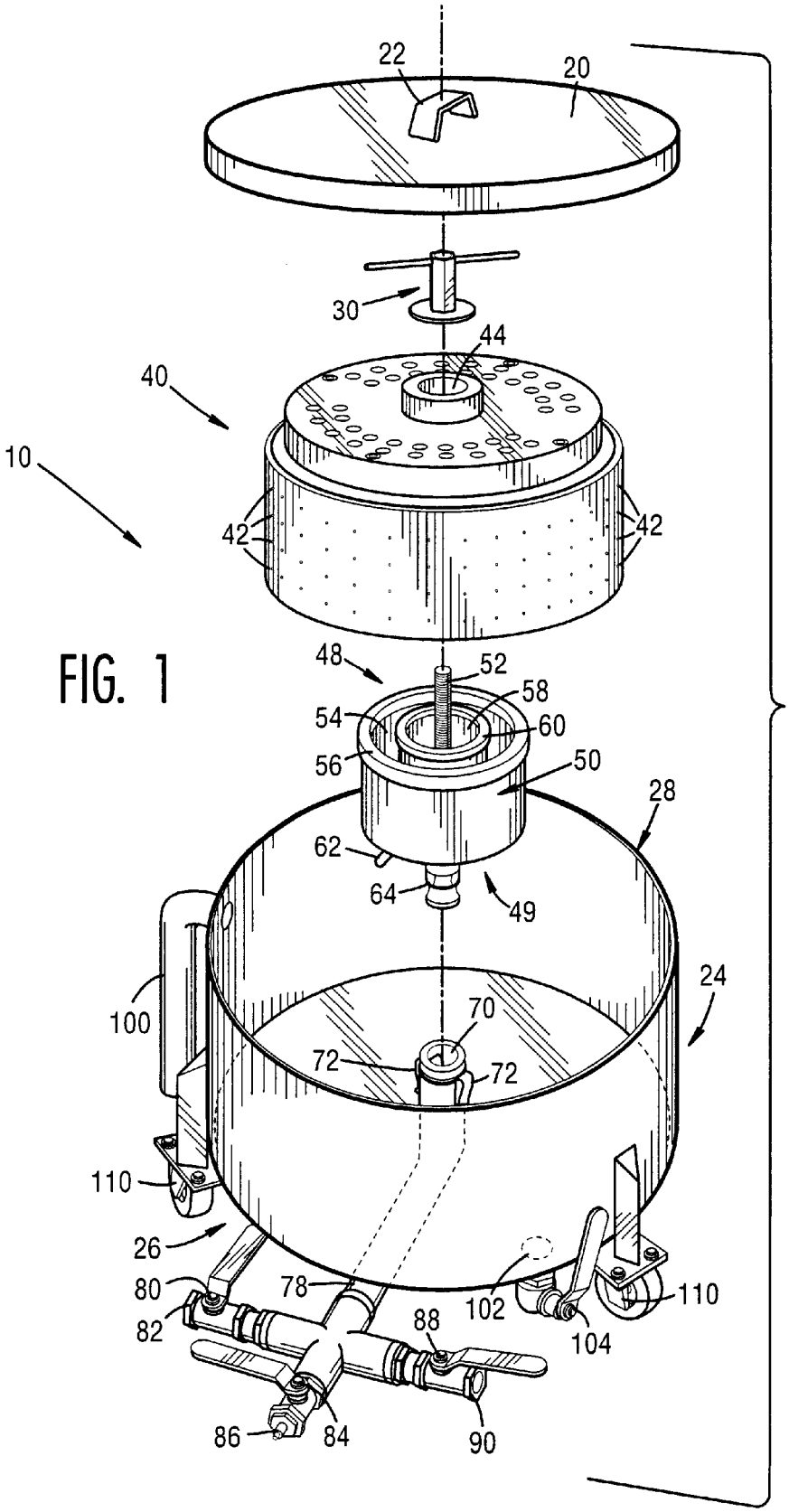
FIG. 1 is an exploded perspective view of a vacuum drum cleaner according to a preferred embodiment of the present invention.
Figure 2:
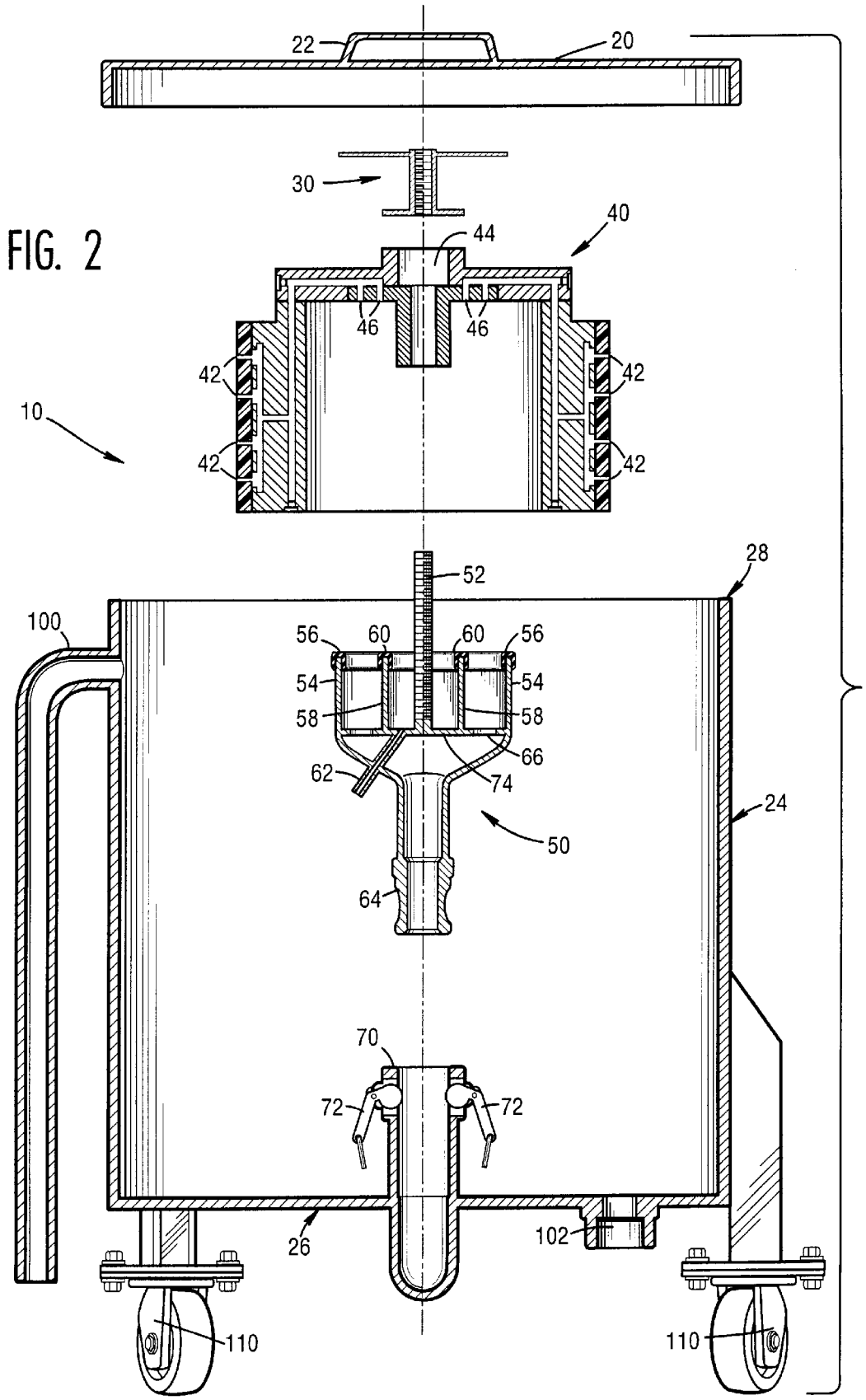
FIG. 2 is a cross-sectional exploded view of a vacuum drum cleaner according to a preferred embodiment of the present invention.

Referring now to the figures, the present invention is a method and apparatus for cleaning a vacuum drum. A drum cleaner according to the present invention is referred to generally in the figures using reference number 10. Drum cleaner 10 basically comprises a housing 24, a drum seat 50 and a lid 20.

The housing 24 has a open top end 28 and closed bottom end 26. Although housing 24 is preferably cylindrical in shape with a diameter and height dimensioned to accommodate vacuum drum 40 and drum seat 50, housing 24 could be rectangular or any other shape as long as it can accommodate vacuum drum 40 and drum seat 50. The housing 24 is preferably made of stainless steel, but aluminum, plastic, plastic composite or any other material that has sufficient strength to house vacuum drum 40 and carry a hot fluid may be used. Casters 110 attached along the bottom of housing 24 provide mobility. Preferably, housing 24 contains three casters 110 equally distributed around the housing 24 for balance. An inlet 70 is formed in the bottom of the housing 24 as a channel for fluids flowing into housing 24. Inlet 70 is preferably a hollow cylinder with a length and thickness suitable for supporting vacuum drum 40. Moreover, the diameter and length of inlet 70 should correspond to the neck 64 of drum seat 40 so that neck 64 can fit into inlet 70. Inlet 70 contains a locking mechanism 72 for detachably securing drum seat 50. Although any locking mechanism that is capable of securing the drum seat may be used, a cam lock is preferred.

A pipe 78 connected to a fluid supply (not shown) is attached to the inlet 70. The pipe 78 is in fluid communication with the inlet 70 in order to delivery fluid, preferably water, to the inlet 70. As illustrated in FIG. 1, a cold water inlet 82, hot water inlet 90 and an air pressure inlet 86 are preferably connected to pipe 78. The temperature and pressure of the fluid can be controlled by adjusting the cold water valve 88, hot water valve 80, and air pressure valve 84. Although cleaner 10 preferably uses manual valves for controlling the pressure and temperature of the fluid, other methods such as computer-controlled electric solenoid valves could also be used to control these parameters of the fluid supply. Moreover, diluted detergents or other cleaning agents could be used in conjunction with or instead of water. A drain hole 102 is also located along the bottom of the housing 24 and that is opened using a drain valve 104 so that the fluid can be drained upon completion of cleaning.

An overflow drain 100 is attached near the top of housing 24. Overflow drain 100 is preferably a L-shaped hollow cylinder and limits the fluid level inside housing 24. If fluid level rises to overflow drain 100, the excess fluid will flow through overflow drain 100 outside housing 24.

Drum seat 50 has a top end 48 and bottom end 49. Bottom end 49 has a hollow cylindrical neck 64 dimensioned to fit into inlet 70 of housing 24. Neck 64 has exterior surface features that allow it to be secured into the inlet 70. Preferably, neck 64 contains a groove that is clamped into place by a cam lock located on inlet 70.

Extending toward the top of drum seat 50 is a wider cylinder formed with an inner ring 58, outer ring 54 and a plate. Rings 54 and 58 are preferably formed so that the space between the inner ring 58 and outer ring 54 will correspond with the position of the vacuum ports 46 on the vacuum drum 40. Along the top of the inner ring 58 and outer ring 54 are an inner gasket 60 and outer gasket 56, respectively, to form a water-tight seal. Although each member of drum seat 50 is preferably made of stainless steel, the members may be made of metal, plastic or composite. However, the outer gasket and inner gasket is preferably made of a synthetic or natural rubber, but may alternatively be made of any material capable of creating a water-tight seal.

Along the plate 74 between the inner ring 58 and the outer ring 54 is a series of interior holes 66. The interior holes 66 provide channels for the fluid to flow to vacuum ports 46 of vacuum drum 40. Along plate 74 of inner ring 58 is a drain 62 for draining water that may flow into inner ring 58.

In the center of the inner ring 58 attached to plate 74 is a threaded rod 52, preferably an acme screw, having a diameter that conforms to the channel 44 of the vacuum drum 40 and has a length greater than the height of vacuum drum 40. Vacuum drum 40 is placed on seat 50 using the threaded rod 52 for alignment and secured into place using a nut 30. Nut 30 is preferably a wing nut that has complementary threads to the threaded rod 52 so that the nut 30 can be tightened using finger pressure. Drum seat 50 can be of varying sizes so long as the space between outer ring 54 and inner ring 58 are aligned with vacuum drum 40. In the preferred embodiment, the diameter and length of neck 64 remains the same for all drum seats so that varying sized drum seats may interchangeably fit into inlet 70.

In FIGS. 7A–7B another embodiment of drum seat 120 is illustrated. In this embodiment vacuum drum 40 (shown in ghost) rests on flange 124 and is sealed with a cover 130. Although most members of this embodiment are preferably made of stainless steel but aluminum or plastic could also be used. However, flange 124 and rim 140 of cover 130 preferably have a rubber outer layer to provide a water-tight seal. Near the bottom of drum seat 120 is a hollow cylindrical neck 134. Neck 134 preferably has exterior surface features that allow neck 134 to be secured into inlet 70. Preferably, neck 134 contains a groove that is clamped into place by a cam lock located on inlet 70. Neck 134 extends to a cylindrical body 122. Body 122 is dimensioned to hold a vacuum drum 40 (shown in ghost). A network of supports 136 are preferably attached between neck 134 and body 122 to provide strength for holding a large vacuum drum 40 (shown in ghost). On the top of body 122 is a series of channels 126 that provide fluid communication with neck 134. Channels 126 are preferably positioned to correspond to vacuum ports 46 in vacuum drum 40 (shown in ghost). A threaded rod is positioned preferably in the center on top of body 122. Threaded rod 128, preferably an acme screw, has a diameter to conform to channel 44 of vacuum drum 40 (shown in ghost) and a length greater than the perimeter of vacuum drum 40 (shown in ghost). Vacuum drum 40 (shown in ghost) is placed on body 122 using threaded rod 128 for alignment and secured into place using a nut 68. Cover 130, preferably dimensioned to fit over a vacuum drum 40, is placed over vacuum drum 40 with threaded rod 128 through hole 132 in cover 130 and secured into place using a nut 144. Nut 144 is preferably a wing nut that has complementary threads to threaded rod 128 so that nut 144 can be tightened using finger pressure.

A lid 20, preferably dimensioned to conform to the top of housing 24, may be placed on housing 24 to keep fluid from splashing from housing 24. Lid 20 may have a handle 22 on top so that lid 20 may be easily placed on top of housing 24.

Figure 3:
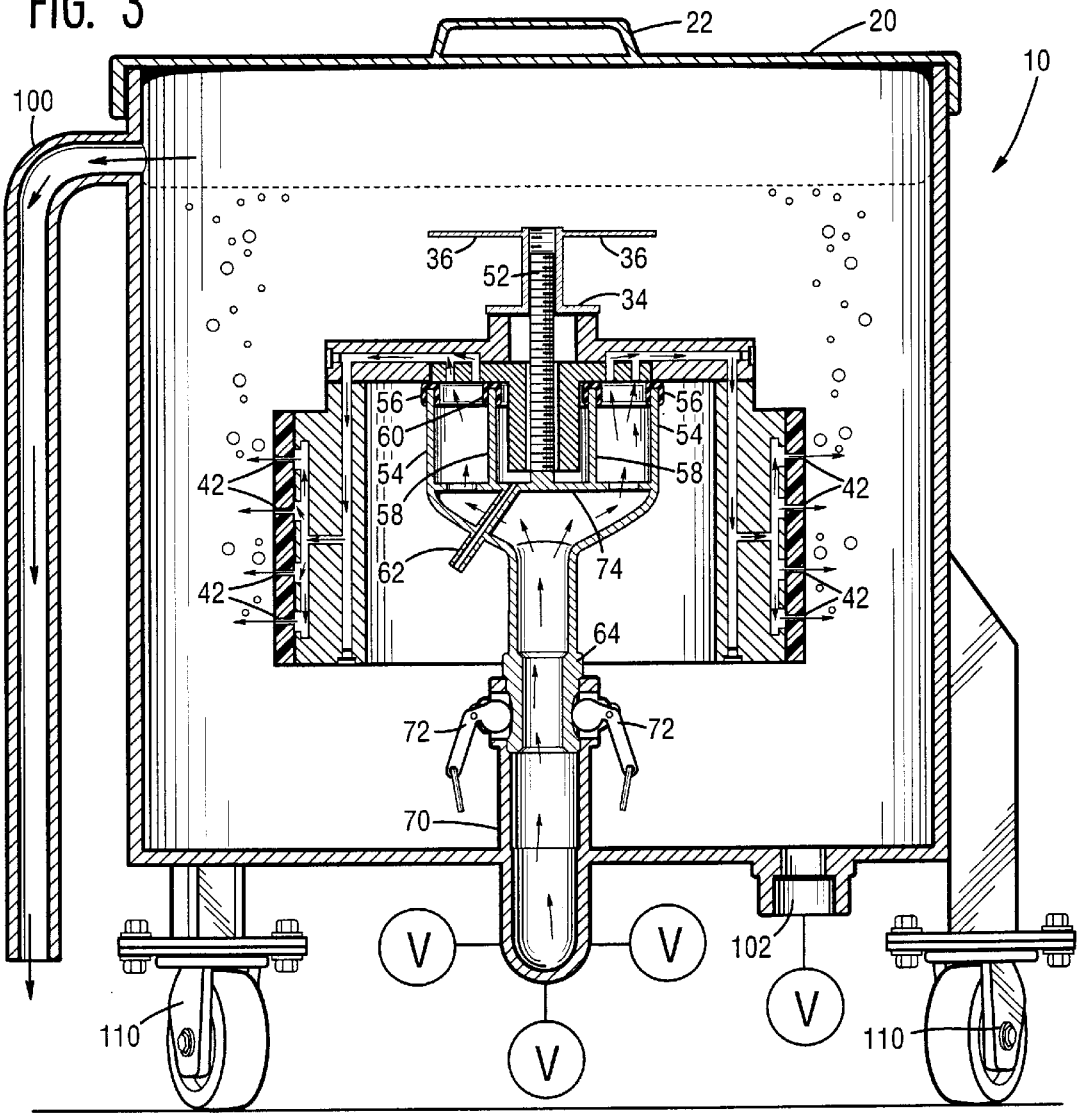
FIG. 3 is a cross-sectional assembled view of a vacuum drum cleaner in operation, according to a preferred embodiment of the present invention.
Figure 4:
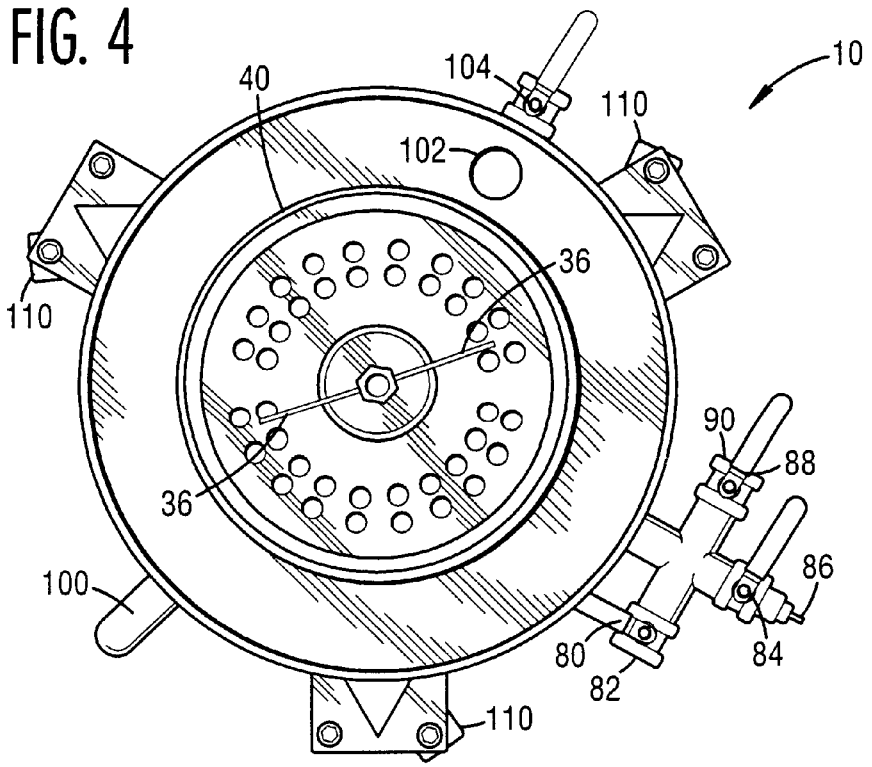
FIG. 4 is a top view of a vacuum drum cleaner with the lid removed and a vacuum drum secured to the drum seat according to a preferred embodiment of the present invention.
Figure 5:
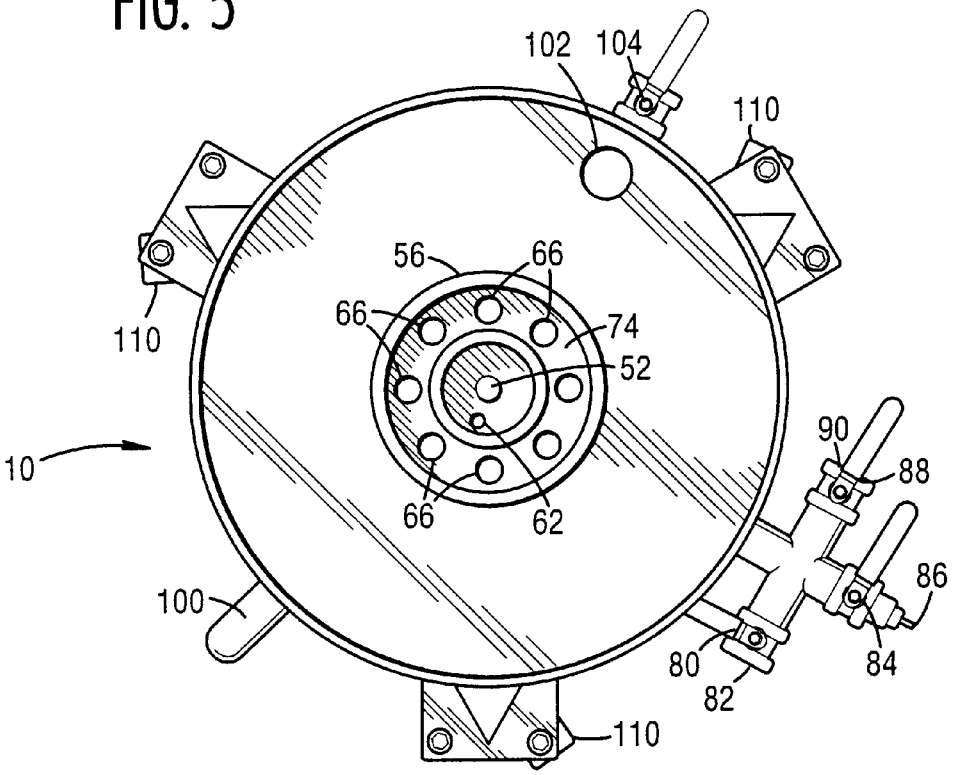
FIG. 5 is a top view of a vacuum drum cleaner with the lid removed and without a vacuum drum secured according to preferred embodiment of the present invention.
Figure 6A:
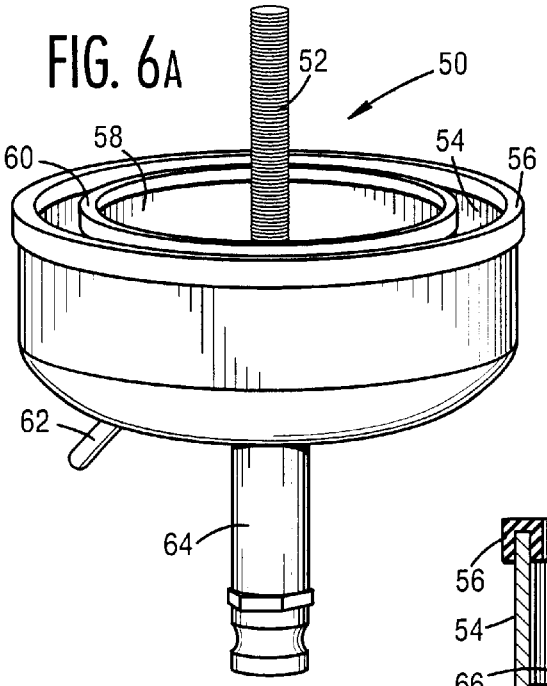
FIG. 6A is a perspective view of a drum seat according to a preferred embodiment of the present invention.
Figure 6B:
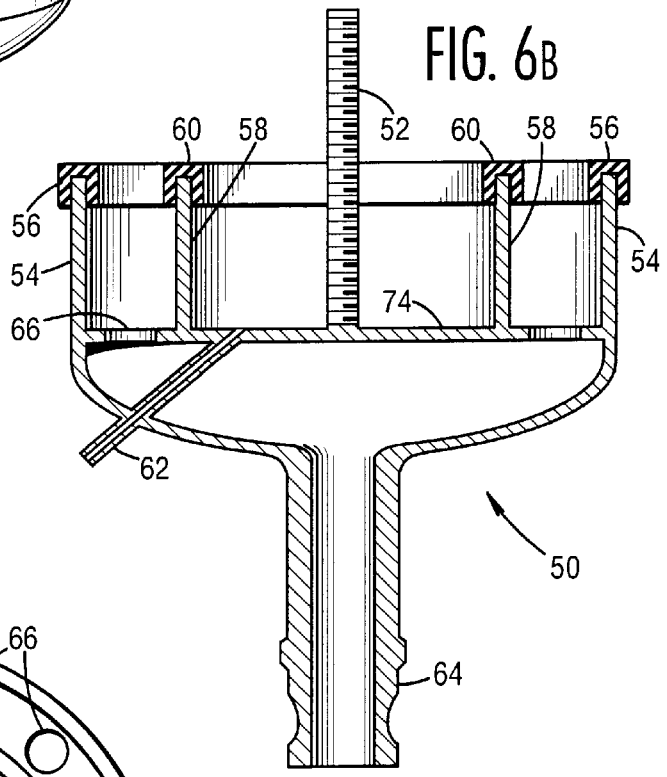
FIG. 6B is a cross-sectional view of a drum seat according to a preferred embodiment of the present invention.
Figure 6C:
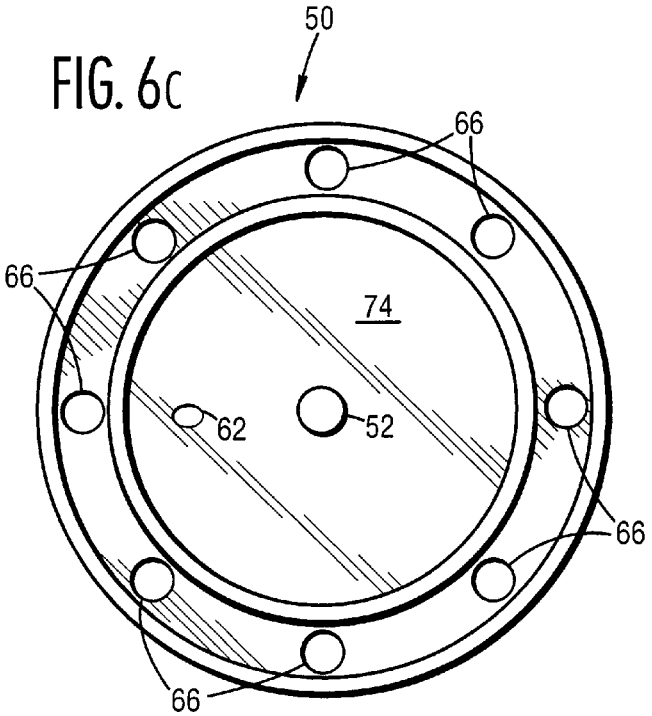
FIG. 6C is a top view of a drum seat according to a preferred embodiment of the present invention.

Drum cleaner 10 in operation is illustrated in operation in FIG. 3. A discrete series of steps is preferably followed to operate drum cleaner 10. First, vacuum drum 40 is placed on the drum seat 50 using the threaded rod 52 for alignment. Next, vacuum drum 40 is secured onto drum seat 50 by tightening nut 30 over threaded rod 52 and placing lid 20 onto housing 24. For the alternative embodiment of drum seat 120, vacuum drum 40 is placed onto flange 124 and cover 130 tightened over vacuum drum 40 by threading nut 144 over the threaded rod 128. Next, hot water supply valve 80 and air supply valve 84 are opened for approximately one minute. The water pressure and temperature preferably are kept to a maximum of 40 pounds per square inch and 140° F., respectively. The flow of water is illustrated in FIGS. 3 and 8. As can be seen, water flows through inlet 70 and neck 64 to interior holes 66 in drum seat 50 to deliver water to vacuum ports 46 of vacuum drum 40 which forces water through perimeter holes 42. Next, hot water valve 80 and air supply valve 84 are closed and drain valve 104 are opened. In order to cool vacuum drum 40 for handling, cold water valve 88 is opened for approximately 30 seconds or until the vacuum drum 40 is cool to the touch. After the water has been drained from housing 24, lid 20 is opened and vacuum drum 40 is removed by untightening nut 30. Next, apply a light hydrocarbon compound, such as dimethylpolysiloxane fluid, which is sold under the trademark ARMORALL to the perimeter of the vacuum drum.

It will be apparent to those skilled in the art that many changes and substitutions can be made to the preferred embodiment herein described without departing from the spirit and scope of the present invention.

What is claimed is:

1. An apparatus for cleaning a vacuum drum having a multiplicity of perimeter holes extending radially inward to fluidly communicate with a plurality of vacuum ports on the end of said vacuum drum, said apparatus comprising:

a housing dimensioned to accommodate said vacuum drum; and cleaning means carried by said housing and adapted to hold said vacuum drum so that fluid is forced through said perimeter holes of said vacuum drum when said vacuum drum is placed in said housing and is held by said cleaning means.

2. The apparatus as recited in claim 1, wherein said cleaning means further comprises:

a drum seat carried by said housing for holding said vacuum drum in sealing engagement with said drum seat; and means for injecting fluid into said vacuum ports of said vacuum drum so that said fluid is forced through said multiplicity of perimeter holes.

3. The apparatus as recited in claim 1, wherein said cleaning means further comprises:

a drum seat carried by said housing and having means for holding said vacuum drum in engagement with said drum seat, means for sealing said vacuum ports of said vacuum drum against said cleaning means so that fluid injected by said cleaning means flows into said vacuum ports, and means in fluid communication with said vacuum ports of said vacuum drum for delivery of said fluid to said vacuum ports.

4. The apparatus as recited in claim 1, wherein said cleaning means further comprises:

a drum seat carried by said housing and having means for securing said vacuum drum to said drum seat, means for sealing said vacuum ports of said vacuum drum to said drum seat so that fluid injected by said drum seat flows into said vacuum ports, and a hollow neck detachably mounted to said housing, the interior of which hollow neck being in fluid communication with said vacuum ports of said vacuum for delivery of said fluid to said vacuum drum; and means for controlling the temperature and pressure of said fluid.

5. The apparatus as recited in claim 1, wherein said cleaning means further comprises:

a drum seat carried by said housing and having means for securing said vacuum drum to said drum seat, and means for sealing said vacuum ports of said vacuum drum to said drum seat so that fluid injected by said cleaning means enters said vacuum ports; and means for controlling the temperature and pressure of said fluid.

6. An apparatus for cleaning a vacuum drum having a multiplicity of perimeter holes extending radially inward and being in fluid communication with a plurality of vacuum ports on the end of said vacuum drum, said apparatus comprising:

a housing dimensioned to accommodate a vacuum drum;

a drum seat carried by said housing and having:

means for holding said vacuum drum in engagement with said drum seat; and means for injecting fluid into said vacuum ports of said vacuum drum; and means for securing said vacuum drum to said drum seat so that fluid injected by said injecting means is forced into said vacuum ports.

7. The apparatus as recited in claim 6, wherein said drum seat further comprises:

means for sealing said vacuum ports of said vacuum drum to said drum seat; and means in fluid communication with said vacuum drum for delivering fluid to said vacuum ports.

8. The apparatus as recited in claim 6, wherein said drum seat further comprises a hollow neck detachably mounted to said housing, the interior of which hollow neck is in fluid communication with said vacuum ports of said vacuum drum.

9. The apparatus as recited in claim 6, wherein said apparatus further comprises means for controlling the temperature and pressure of said fluid.

10. An apparatus for cleaning a vacuum drum having a multiplicity of perimeter holes extending radially inward and in fluid communication with a plurality of vacuum ports on the end of said vacuum drum, said apparatus comprising:

a housing;

fluid supply means for supplying fluid to said vacuum ports in said vacuum drum when said vacuum drum is positioned in said housing so that said fluid is dischargable through said perimeter holes; and attaching means carried by said housing for sealingly attaching said vacuum drum to said fluid supply means.

11. The apparatus as recited in claim 10, wherein said fluid supply means has an inner ring; and an opposing outer ring concentric to and spaced apart from said inner ring, said inner ring and said outer ring defining an inlet therebetween in fluid communication with said vacuum ports.

12. The apparatus as recited in claim 10, wherein said fluid supply means has an inner ring;

an opposing outer ring concentric to and spaced apart from said inner ring, said inner ring and said outer ring defining an inlet therebetween in fluid communication with said vacuum ports;

an outer gasket attached to the rim of said outer ring; and an inner gasket attached to the rim of said inner ring.

13. The apparatus as recited in claim 10, wherein said fluid supply means has an inner ring;

an opposing outer ring concentric to and spaced apart from said inner ring, said inner ring and said outer ring defining an inlet therebetween in fluid communication with said vacuum ports; and said attaching means further comprises a threaded rod attached to said inner ring and a threaded nut for securing said vacuum drum to said inner and said outer rings.

14. The apparatus as recited in claim 10, further comprising means carried by said housing for controlling the temperature of said fluid.

15. The apparatus as recited in claim 10, further comprising means carried by said housing for controlling the pressure of said fluid.

16. The apparatus as recited in claim 10, wherein said attaching means includes a cam lock.

* * * * *